US010804665B2

(12) United States Patent
Masuda et al.

(10) Patent No.: US 10,804,665 B2
(45) Date of Patent: Oct. 13, 2020

(54) TERMINAL CRIMPING METHOD AND TERMINAL CRIMPING STRUCTURE

(71) Applicant: YAZAKI CORPORATION, Tokyo (JP)

(72) Inventors: Satoki Masuda, Shizuoka (JP); Yoshinao Sato, Shizuoka (JP); Takeo Ida, Shizuoka (JP); Junpei Hayashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/386,078

(22) Filed: Apr. 16, 2019

(65) Prior Publication Data

US 2019/0356101 A1 Nov. 21, 2019

(30) Foreign Application Priority Data

May 21, 2018 (JP) ..... 2018-097222

(51) Int. Cl.
*B21D 41/00* (2006.01)
*H01R 43/048* (2006.01)
*H01R 4/18* (2006.01)

(52) U.S. Cl.
CPC ..... *H01R 43/048* (2013.01); *H01R 4/183* (2013.01)

(58) Field of Classification Search
CPC .... B21J 7/14; B21F 1/00; B21B 19/04; B21D 15/04
USPC ..... 72/402, 403, 367.1, 370.21
See application file for complete search history.

(56) References Cited

U.S. PATENT DOCUMENTS

| | | | | |
|---|---|---|---|---|
| 6,438,823 | B2 * | 8/2002 | Yamakawa | H01R 43/058 29/33 M |
| 6,568,075 | B1 | 5/2003 | Yamakawa | |
| 2001/0002508 | A1 | 6/2001 | Yamakawa | |
| 2015/0140851 | A1 * | 5/2015 | Wang | H01R 13/5221 439/275 |
| 2015/0155638 | A1 | 6/2015 | Nagahashi | |

FOREIGN PATENT DOCUMENTS

| | | | |
|---|---|---|---|
| JP | 2000-21543 | A | 1/2000 |
| JP | 2011-171057 | A | 9/2011 |
| JP | 2013-239276 | A | 11/2013 |
| JP | 2017-147419 | A | 8/2017 |
| WO | 2011/102536 | A1 | 8/2011 |

* cited by examiner

*Primary Examiner* — Phuong Chi Thi Nguyen
(74) *Attorney, Agent, or Firm* — Kenealy Vaidya LLP

(57) ABSTRACT

A terminal crimping method includes covering an end portion of an electric wire with a fixing cylinder portion of a terminal, caulking and crimping the fixing cylinder portion by a pair of dies including pressing projections each having a flat shape in which a length in one axial direction is longer than a length in the other axial direction orthogonal to the one axial direction in a plan view, and caulking the fixing cylinder portion by the pressing projections to form crimp recess portions, in the caulking and crimping the fixing cylinder portion.

4 Claims, 13 Drawing Sheets

TERMINAL CRIMPING METHOD AND TERMINAL CRIMPING STRUCTURE

CROSS REFERENCE TO RELATED APPLICATIONS

This application claims priority from Japanese Patent Application No. 2018-097222 filed on May 21, 2018, the entire contents of which are incorporated herein by reference.

BACKGROUND OF THE INVENTION

Field of the Invention

The present invention relates to a terminal crimping method and a terminal crimping structure.

Description of Related Art

As a technology for crimping a terminal to an electric wire, for example, there has been known a technique of caulking and crimping a cylindrical terminal into which an electric wire is inserted to have a hexagonal cross section by abutting a pair of dies including a recess portion having a shape, in which a hexagonal cross section is bisected, on each other (see, for example, the patent document 1: JP-A-2000-21543 and the patent document 2: JP-A-2011-171057).

[Patent Document 1] JP-A-2000-21543

[Patent Document 2] JP-A-2011-171057

According to a related art, pressing projections provided at opposing places of each die are bitten into a terminal to increase a crimping force with an electric wire. However, there is concern that a part of a conductor of the electric wire may be damaged when the pressing projections are bitten into the terminal by abutting the dies on each other.

SUMMARY

One or more embodiments provide a terminal crimping method and a terminal crimping structure capable of firmly crimping a terminal while reducing damage to a conductor of an electric wire as much as possible.

In order to achieve the above-mentioned object, a terminal crimping method according to the invention is characterized in the following (1) to (3).

In an aspect (1), a terminal crimping method includes covering an end portion of an electric wire with a fixing cylinder portion of a terminal, caulking and crimping the fixing cylinder portion by a pair of dies including pressing projections each having a flat shape in which a length in one axial direction is longer than a length in the other axial direction orthogonal to the one axial direction in a plan view, and caulking the fixing cylinder portion by the pressing projections to form crimp recess portions, in the caulking and crimping the fixing cylinder portion.

In an aspect (2), the fixing cylinder portion is caulked by the dies such that a longitudinal direction of each of the pressing projections which is the one axial direction, is aligned in an orthogonal direction which is orthogonal to an axis direction of the electric wire in which the terminal is crimped.

In an aspect (3), the electric wire includes a shield conductor formed of a braid. The terminal includes a crimp cylinder portion through which the electric wire is inserted and a fixing member having the fixing cylinder portion. The fixing cylinder portion is caulked by the dies, in a state that the shield conductor which is folded back is disposed between the crimp cylinder portion and the fixing cylinder portion of the fixing member.

According to the aspect (1), a pressing projection provided in each die to increase a crimping force of a caulking portion is formed in a flat shape in which a length in one axial direction is longer than a length in the other axial direction orthogonal to the one axial direction in plan view. Thus, an area of the pressing projection can be increased, and even when a projecting dimension of the pressing projection is decreased, a sufficient crimping force can be secured. Accordingly, it is possible to reduce stress concentration at a bitten place of the pressing projection when a fixing cylinder portion of a terminal is caulked. Thus, it is possible to reduce damage to a conductor of an electric wire.

According to the aspect (2), by caulking the fixing cylinder portion such that a longitudinal direction of the pressing projection is aligned in a direction orthogonal to an axis of the electric wire, a longitudinal direction of the crimp recess portion to be formed in the fixing cylinder portion can be aligned in the direction orthogonal to the axis of the electric wire. Thus, it is possible to make the terminal compact by reducing a length of the fixing cylinder portion of the terminal in an axial direction.

According to the aspect (3), it is possible to reduce damage to a shield conductor formed of a braid and to obtain a good shielding effect.

In order to achieve the above object, a terminal crimping structure according to the invention is characterized in the following (4) to (6).

In an aspect (4), a terminal crimping structure includes an electric wire and a terminal. The terminal includes a fixing cylinder portion which covers an end portion of the electric wire. The fixing cylinder portion is calked and crimped. Crimp recess portions having a flat shape in which a length in one axial direction is longer than a length in other axial direction orthogonal to the one axial direction in plan view are formed in the fixing cylinder portion which is calked.

In an aspect (5), a longitudinal direction of each of the crimp recess portions which is the one axial direction, is aligned in an orthogonal direction which is orthogonal to an axis direction of the electric wire in which the terminal is crimped.

In an aspect (6), the electric wire includes a shield conductor formed of a braid. The terminal includes a crimp cylinder portion through which the electric wire is inserted and a fixing member having the fixing cylinder portion. The fixing cylinder portion is caulked, in a state that the shield conductor which is folded back is disposed between the crimp cylinder portion and the fixing cylinder portion of the fixing member.

According to the aspect (4), a crimp recess portion is formed and a crimping force of a caulking portion is increased. The crimp recess portion is formed in a flat shape in which a length in one axial direction is longer than a length in the other axial direction orthogonal to the one axial direction in plan view. That is, an area of the crimp recess portion is increased, and even when a depth dimension of the crimp recess portion is decreased, a sufficient crimping force is secured. Accordingly, it is possible to reduce stress concentration when the crimp recess portion is formed and to reduce damage to a conductor of an electric wire.

According to the aspect (5), a longitudinal direction of the crimp recess portion formed in a fixing cylinder portion is aligned in a direction orthogonal to an axis of the electric wire. Thus, it is possible to make a terminal compact by reducing a length of the fixing cylinder portion of the terminal in an axial direction.

According to the aspect (6), it is possible to reduce damage to a shield conductor formed of a braid and to obtain a good shielding effect.

According to one or more embodiments, it is possible to provide a terminal crimping method and a terminal crimping structure capable of firmly crimping a terminal while reducing damage to a conductor of an electric wire as much as possible.

The invention has been described above briefly. The details of the invention will become more apparent by reading through a mode for carrying out the invention described below with reference to the accompanying drawings.

BRIEF DESCRIPTION OF THE DRAWINGS

FIGS. 4A to 4C are views illustrating a shape of a crimp recess portion, wherein FIG. 4A is a plan view, FIG. 4B is a cross-sectional view taken along a direction orthogonal to an axis of the electric wire, and FIG. 4C is a cross-sectional view taken along the axis of the electric wire;

FIGS. 7A and 7B are views for explaining a die for crimping a terminal to an end portion of an electric wire, wherein FIG. 7A is a perspective view of the die, and FIG. 7B is a schematic configuration diagram of a crimping place of the electric wire by a pair of dies;

FIGS. 8A and 8B are views for explaining a die according to Reference Example 1 in which a terminal is crimped to an end portion of an electric wire, wherein FIG. 8A is a perspective view of the die, and FIG. 8B is a schematic configuration view of the crimping place of the electric wire by a pair of the dies;

FIGS. 9A to 9C are illustrating a shape of a crimp recess portion according to Modification Example 1, wherein FIG. 9A is a plan view, FIG. 9B is a cross-sectional view taken along a direction orthogonal to an axis of an electric wire, and FIG. 9C is a cross-sectional view taken along the axis of the electric wire;

FIG. 10A is a plan view, FIG. 10B is a cross-sectional view taken along a direction orthogonal to an axis of an electric wire, and FIG. 10C is a cross-sectional view taken along the axis of the electric wire;

DETAILED DESCRIPTION

Hereinafter, examples of embodiments will be described with reference to the drawings.

First Embodiment

First, a terminal crimping method and a terminal crimping structure according to a first embodiment will be described.

Figure 1:
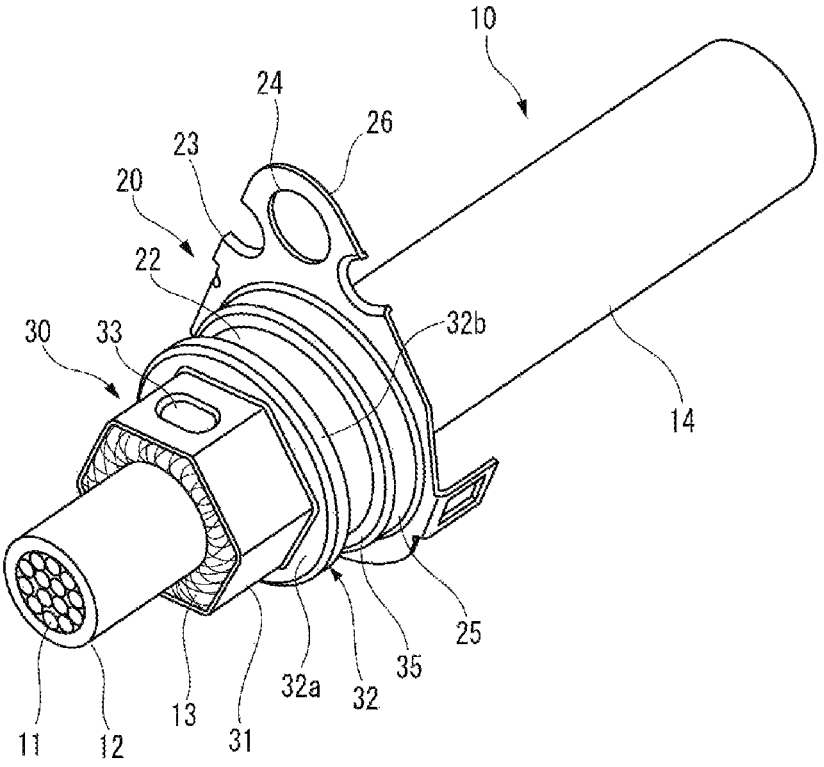
FIG. 1 is a perspective view of an end portion of an electric wire to which a terminal is crimped for explaining a terminal crimping structure according to a first embodiment.
Figure 2:
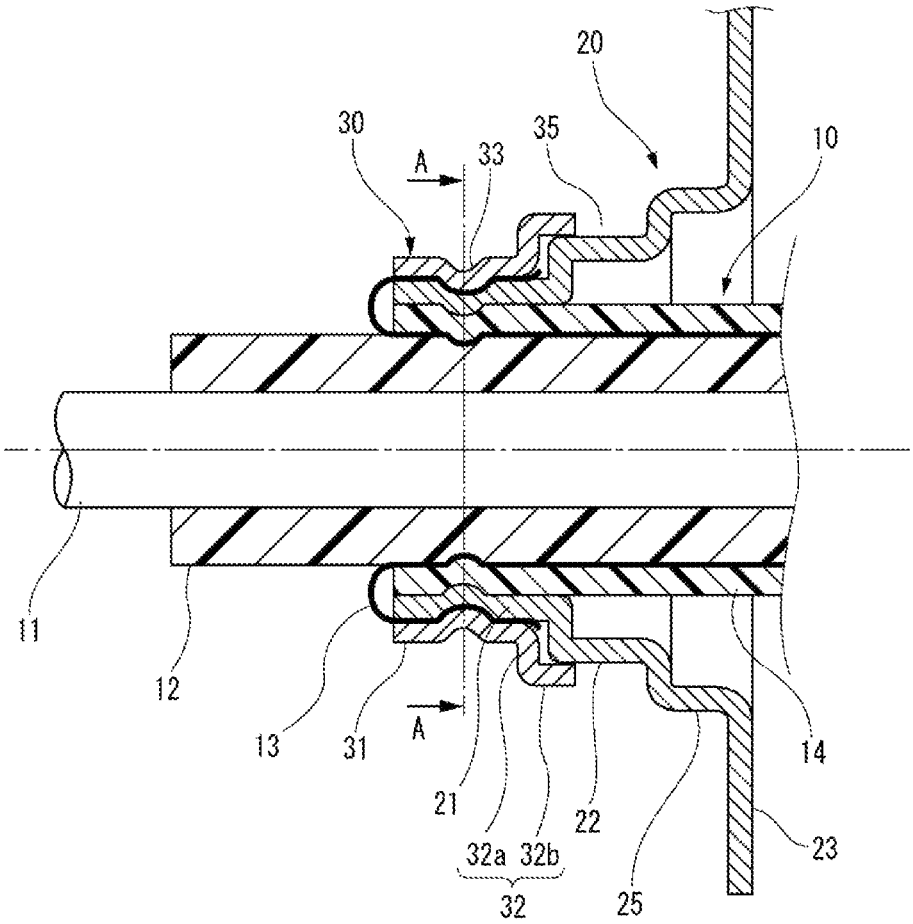
FIG. 2 is a cross-sectional view taken along an axis of the electric wire to which the terminal is crimped for explaining the terminal crimping structure according to the first embodiment.
Figure 3:
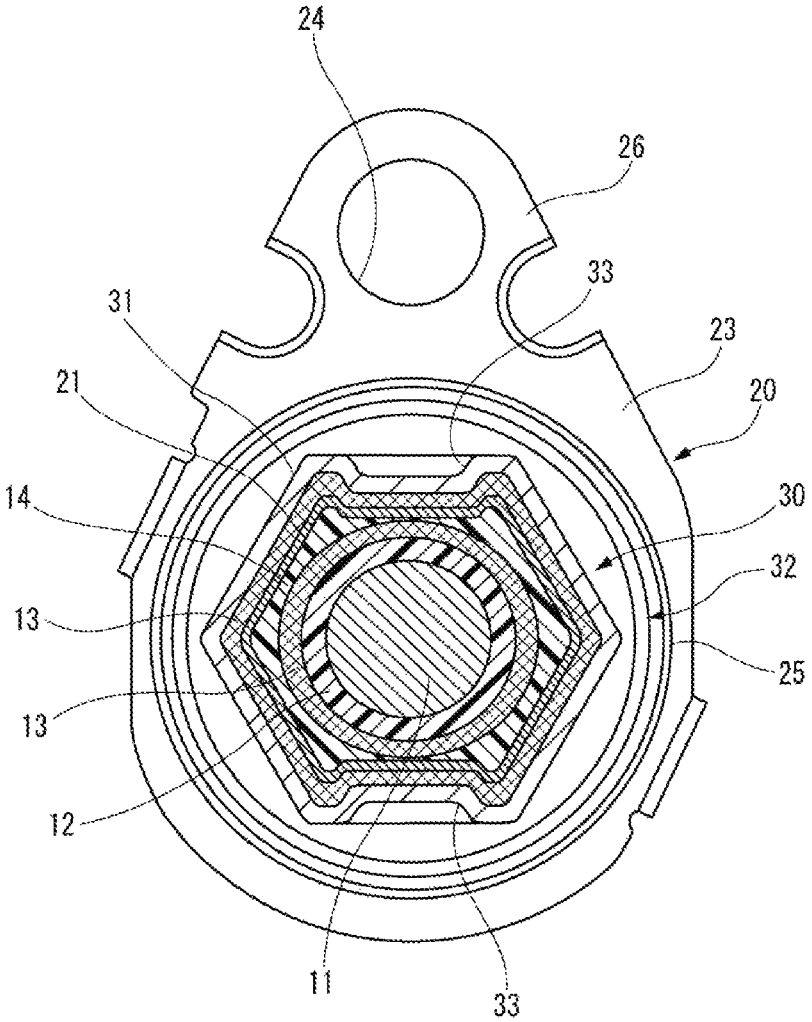
FIG. 3 is a cross-sectional view taken along line A-A in FIG. 2.

FIG. 1 is a perspective view of an end portion of an electric wire to which a terminal is crimped for explaining a terminal crimping structure according to a first embodiment. FIG. 2 is a cross-sectional view taken along an axis of the electric wire to which the terminal is crimped for explaining the terminal crimping structure according to the first embodiment. FIG. 3 is a cross-sectional view taken along line A-A in FIG. 2.

As illustrated in FIGS. 1 to 3, the crimping structure according to the first embodiment is a structure in which a terminal 20 is crimped and fixed to an electric wire 10. The terminal 20 is provided with a fixing member 30 and is crimped and fixed to the electric wire 10 through the fixing member 30.

The electric wire 10 is a shield electric wire formed of a coaxial cable including a central conductor 11, an insulator 12, a shield conductor 13, and a sheath 14. The central conductor 11 is formed of, for example, a stranded wire formed by stranding element wires of copper or a copper alloy. The insulator 12 is formed of a resin material having insulating properties and is provided to cover the periphery of the central conductor 11. The shield conductor 13 is, for example, a braid formed by braiding element wires of copper or a copper alloy and is provided to cover the periphery of the insulator 12. The sheath 14 is formed of a resin material having insulating properties and is provided to cover the periphery of the shield conductor 13.

At an end portion of the electric wire 10, the central conductor 11 and the shield conductor 13 are exposed. The terminal 20 is mounted on an end portion of the sheath 14. In the portion where the terminal 20 is mounted, the shield conductor 13 exposed from the sheath 14 is folded back and covered. On the portion where the shield conductor 13 is folded back and covered, the fixing member 30 is mounted. The fixing member 30 is mounted from a distal end side of the electric wire 10.

The terminal 20 is a shield terminal to be electrically connected to the shield conductor 13 of the electric wire 10.

For example, the terminal 20 is formed by pressing a conductive metal plate of copper, a copper alloy, or the like, and includes a crimp cylinder portion 21, a large diameter cylinder portion 22, a step portion 25, and a plate-like portion 23. The crimp cylinder portion 21 is fixed to the end portion of the inserted electric wire 10. The large diameter cylinder portion 22 is formed to have a larger diameter than the crimp cylinder portion 21 and is provided on the rear end side of the crimp cylinder portion 21. The step portion 25 is formed to have a larger diameter than the large diameter cylinder portion 22 and is provided on the rear end side of the large diameter cylinder portion 22. The plate-like portion 23 protrudes outward in a radial direction on the rear end side of the step portion 25. The plate-like portion 23 is provided with a fixing plate portion 26 provided with an insertion hole 24 at a part thereof.

For example, the fixing member 30 is formed by pressing a conductive metal plate of copper, a copper alloy, or the like and includes a fixing cylinder portion 31 and a flange portion 32. The fixing cylinder portion 31 is fixed to the crimp cylinder portion 21 of the terminal 20 covered with the shield conductor 13. In the fixing member 30 before caulking, the fixing cylinder portion 31 is formed in a cylindrical shape. The flange portion 32 includes a flange plate portion 32*a* extending outward in the radial direction from the cylindrically formed fixing cylinder portion 31, and an engaging cylinder portion 32*b* extending from an outer edge of the flange plate portion 32*a* to the rear end side. The engaging cylinder portion 32*b* of the flange portion 32 is formed to have a larger diameter than the fixing cylinder portion 31, and is fitted to the large diameter cylinder portion 22 of the terminal 20 from the distal end side. Thus, in the large diameter cylinder portion 22, an annular recess portion 35 is formed on the outer periphery thereof from the step portion 25 and the flange portion 32 of the fixing member 30. In the annular recess portion 35, a seal member (not illustrated) formed in an annular shape is accommodated.

The fixing cylinder portion 31 of the fixing member 30 is caulked together with the crimp cylinder portion 21 of the terminal 20 to have a hexagonal cross section. Thus, in the portion of the sheath 14 at the end portion of the electric wire 10, the crimp cylinder portion 21 of the terminal 20, the shield conductor 13, and the fixing cylinder portion 31 of the fixing member 30 are crimped and fixed. In the fixing cylinder portion 31 of the fixing member 30 caulked to have a hexagonal cross section, crimp recess portions 33 are formed on two opposite surfaces of the six surfaces.

Figure 4A:
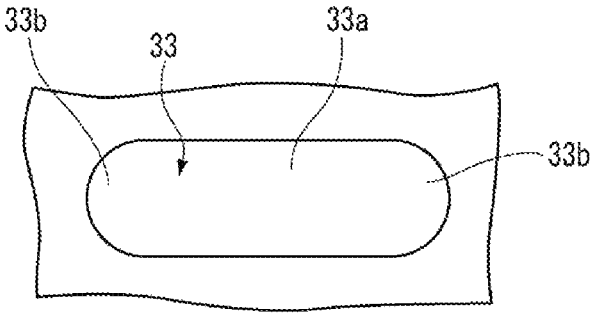
Figure 4B:
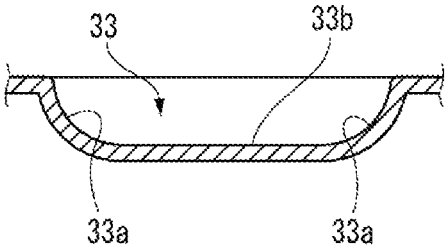
Figure 4C:
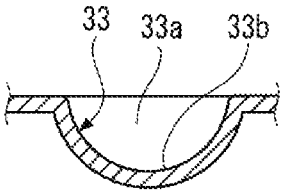

FIGS. 4A to 4C are views illustrating a shape of the crimp recess portion, FIG. 4A is a plan view, FIG. 4B is a cross-sectional view taken along a direction orthogonal to an axis of the electric wire, and FIG. 4C is a cross-sectional view taken along the axis of the electric wire.

As illustrated in FIG. 4A, the crimp recess portion 33 has a flat shape in which the length in one axial direction is longer than the length in the other axial direction orthogonal to the one axial direction in plan view. Specifically, the planar shape of the crimp recess portion 33 is formed in an oval shape which is long in a direction orthogonal to the axis of the electric wire 10 in plan view. As illustrated in FIG. 4B, the cross-sectional shape of the crimp recess portion 33 along a direction orthogonal to the axis of the electric wire 10 is formed in a concave shape in which both end portions 33*a* are formed in a circular arc shape, and the both end portions 33*a* having a circular arc shape are connected on a linear bottom portion 33*b*. As illustrated in FIG. 4C, the cross-sectional shape of the crimp recess portion 33 along the axis of the electric wire 10 is formed in a semicircular shape.

The terminal 20 provided at the end portion of the electric wire 10 is connected to a case formed of a conductive metal material such as an inverter, a motor, or a battery. Specifically, the terminal 20 is inserted into a mounting hole of the case, a screw inserted into the insertion hole 24 formed in the fixing plate portion 26 of the plate-like portion 23 is screwed into a screw hole of the case, and the terminal is fixed such that the terminal is electrically connected to the case.

When the terminal 20 is fixed to the case as such, the shield conductor 13 of the electric wire 10 is electrically connected to the case, and a shielding effect is obtained. Therefore, influence of external noise such as electromagnetic waves is reduced and leakage of radiation noise such as electromagnetic waves from the electric wire 10 to the outside is reduced.

Next, the crimping method of caulking and crimping the terminal 20 to the electric wire 10 will be described.

Figure 5A:
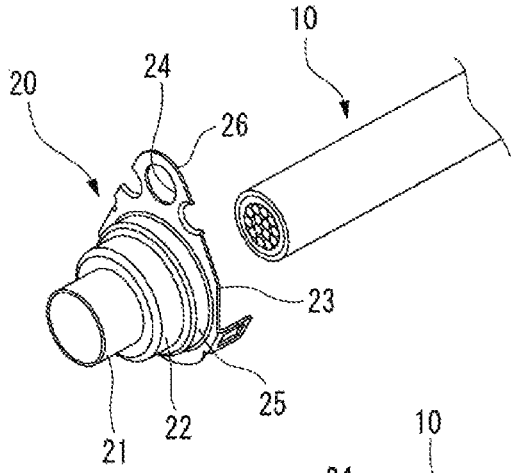
FIGS. 5A to 5C are views for explaining a procedure of crimping a terminal on an end portion of an electric wire, and are perspective views illustrating the end portion of the electric wire, respectively.
Figure 5B:
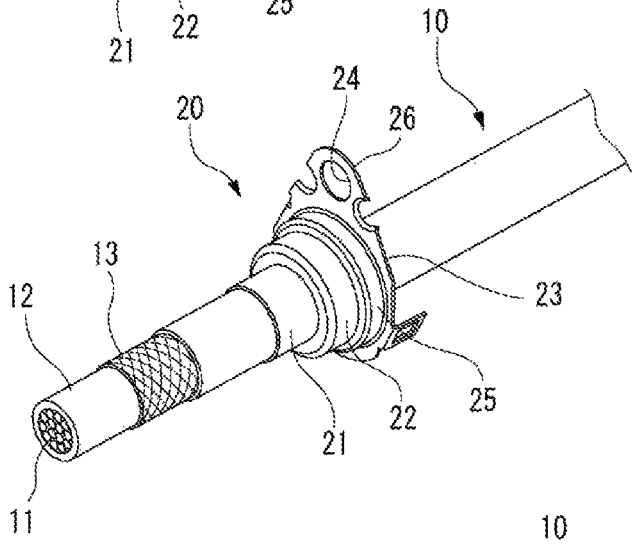
Figure 5C:
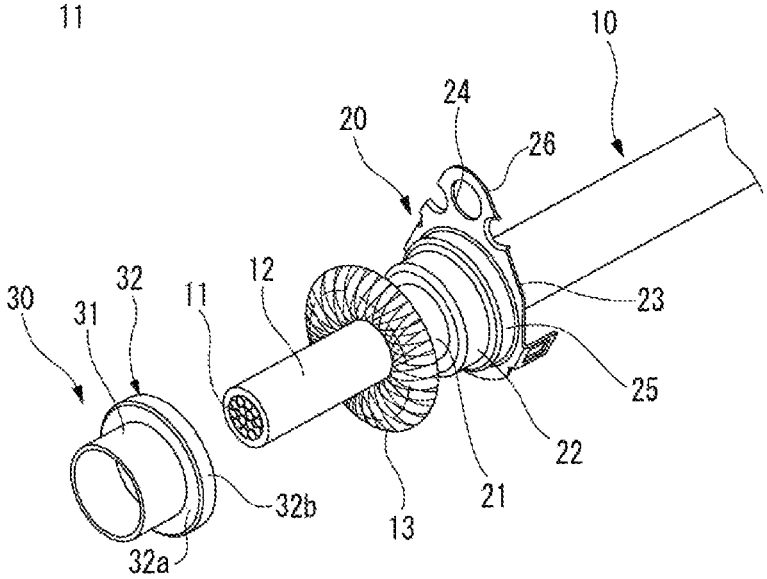
Figure 6A:
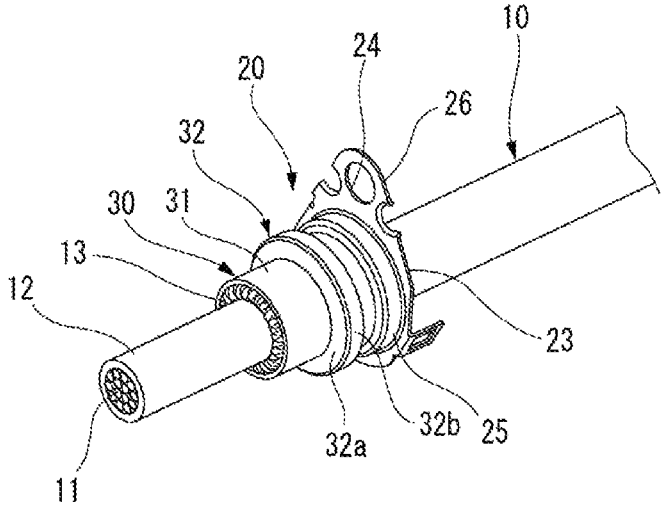
FIGS. 6A and 6B are perspective views for explaining a step of crimping a terminal to an end portion of an electric wire, and are perspective views illustrating the end portion of the electric wire, respectively.
Figure 6B:
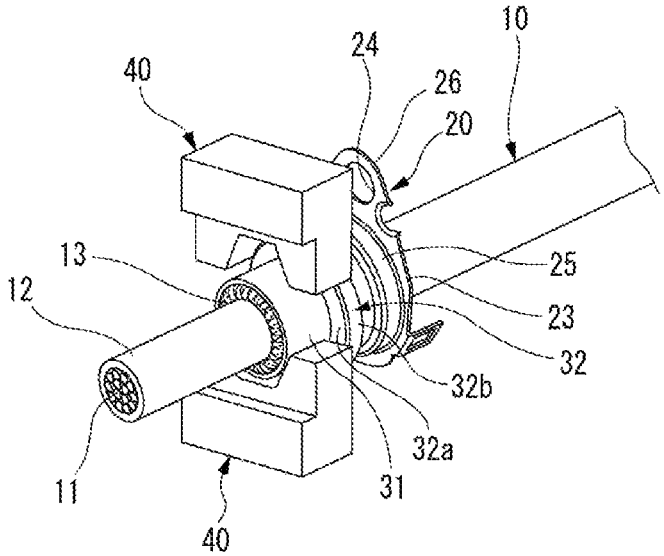
Figure 7A:
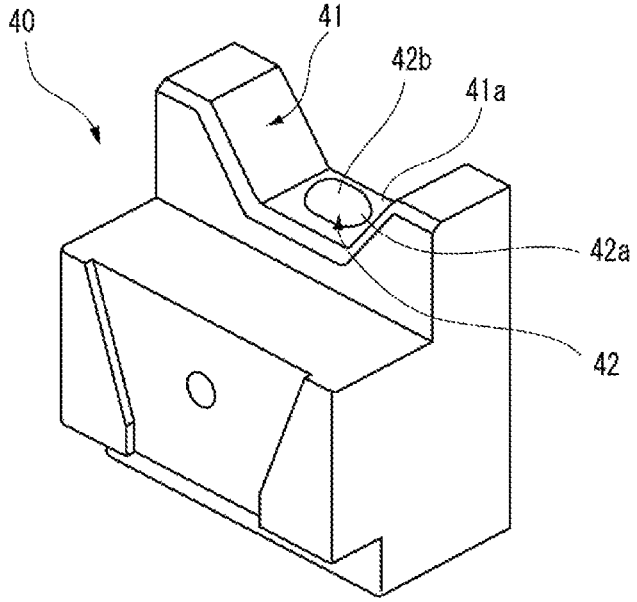
Figure 7B:
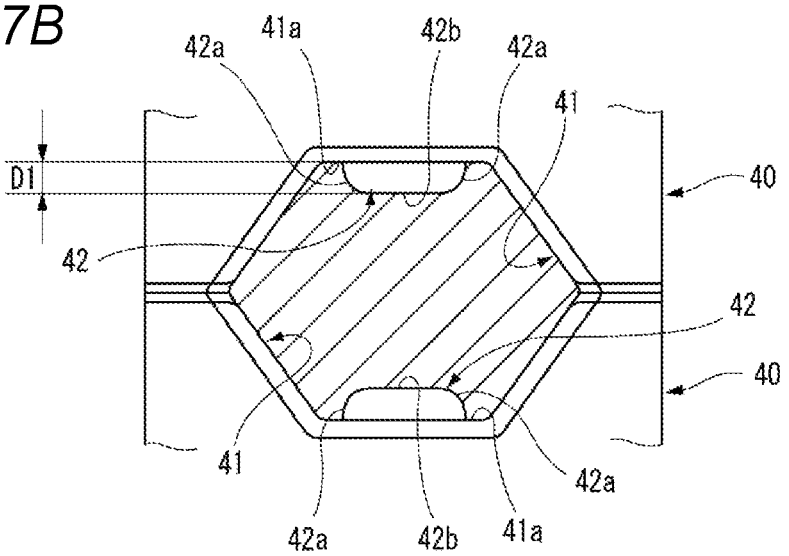

FIGS. 5A to 5C are views for explaining a procedure of crimping the terminal on the end portion of the electric wire, and FIGS. 5A to 5C are perspective views illustrating the end portion of the electric wire, respectively. FIGS. 6A and 6B are perspective views for explaining a step of crimping the terminal to the end portion of the electric wire, and FIGS. 6A and 6B are perspective views illustrating the end portion of the electric wire, respectively. FIGS. 7A and 7B are views for explaining a die for crimping the terminal to the end portion of the electric wire, FIG. 7A is a perspective view of the die, and FIG. 7B is a schematic configuration diagram of a crimping place of the electric wire by a pair of dies;

As illustrated in FIG. 5A, the end portion of the electric wire 10 is inserted into the terminal 20 in which the crimp cylinder portion 21 is formed in a cylindrical shape. As illustrated in FIG. 5B, by subjecting the electric wire 10 to a terminal treatment, the shield conductor 13 is exposed. As illustrated in FIG. 5C, the shield conductor 13 is widened and the shield conductor 13 is folded back to cover the outer periphery of the crimp cylinder portion 21 of the terminal 20.

As illustrated in FIG. 6A, the fixing member 30 in which the fixing cylinder portion 31 is formed in a cylindrical shape is inserted and fitted from the end portion of the electric wire 10 and the fixing cylinder portion 31 of the fixing member 30 is fitted to the crimp cylinder portion 21 covered with the shield conductor 13. As illustrated in FIG. 6B, the crimp cylinder portion 21 of the terminal 20 to which the fixing cylinder portion 31 of the fixing member 30 is fitted is crimped by abutting a pair of dies 40.

As illustrated in FIGS. 7A and 7B, the dies 40 have trapezoidal caulking recess portions 41 formed by bisecting a hexagon on the abutting side of each other. That is, a hexagonal caulking space portion formed by the caulking recess portions 41 of each die 40 is formed by abutting the dies 40 on each other.

On a bottom portion 41*a* forming the caulking recess portion 41 of each die 40, a pressing projection 42 having a projecting dimension D1 is formed. The pressing projection 42 has a flat shape in which the length in one axial direction is longer than the length in the other axial direction orthogonal to the one axial direction in plan view. Specifically, the pressing projection 42 is formed in an oval shape which is long in the direction orthogonal to the axis of the electric wire 10 crimped in a planar shape in plan view. The cross-sectional shape of the pressing projection 42 along the direction orthogonal to the axis of the electric wire 10 is a convex shape in which both end portions 42*a* are formed in a circular arc shape and the both end portion 42 having a circular arc shape are connected at a linear top portion 42*b*. The cross-sectional shape of the pressing projection 42 along the axis of the electric wire 10 is formed in a semicircular shape.

When the pair of dies 40 are abutted on each other with the crimp cylinder portion 21, to which the fixing cylinder portion 31 of the fixing member 30 is fitted, interposed therebetween, the fixing cylinder portion 31 and the crimp cylinder portion 21 are caulked by the caulking recess portions 41 of the dies 40 through the shield conductor 13 and are formed in a hexagonal shape. Thus, the terminal 20 is crimped and fixed to the end portion of the electric wire 10, the shield conductor 13 of the electric wire 10 is interposed between the crimp cylinder portion 21 of the terminal 20 and the fixing cylinder portion 31, and thus the terminal 20 and the shield conductor 13 are electrically connected. The pressing projections 42 formed in the bottom portions 41*a* of the caulking recess portions 41 of each die 40 are bitten into the fixing cylinder portion 31 to form the crimp recess portions 33. Thus, the crimping force at the crimping place is increased.

Here, Reference Example 1 will be described.

Figure 8A:
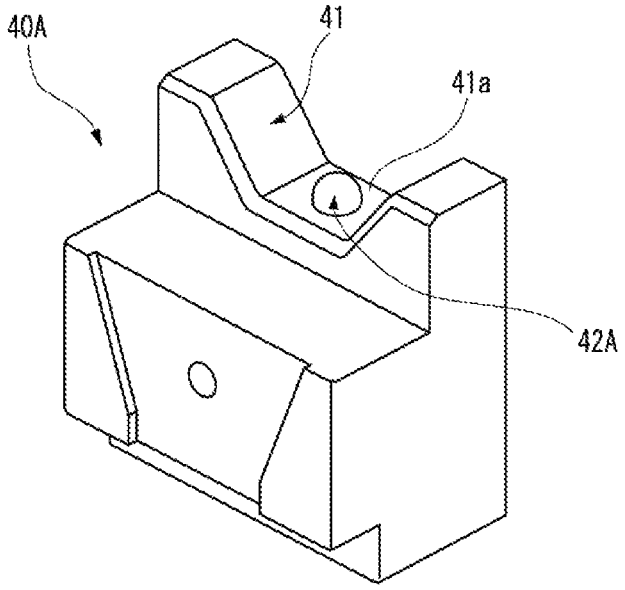
Figure 8B:
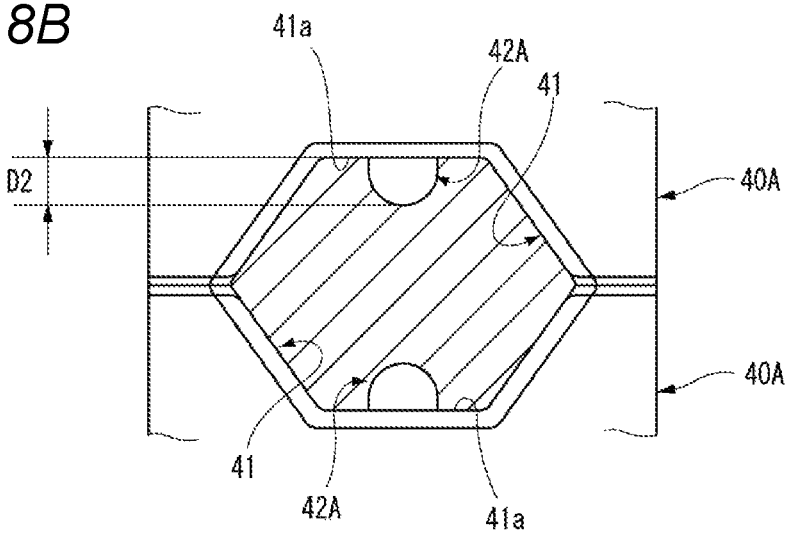

FIGS. 8A and 8B are views for explaining a die according to Reference Example 1 in which a terminal is crimped to an end portion of an electric wire, FIG. 8A is a perspective view of the die, and FIG. 8B is a schematic configuration view of the crimping place of the electric wire by a pair of the dies.

As illustrated in FIGS. 8A and 8B, in Reference Example 1, the crimp cylinder portion 21 of the terminal 20, to which the fixing cylinder portion 31 of the fixing member 30 is fitted, is caulked using a pair of dies 40A. Each die 40A is provided with a pressing projection 42A having a projecting dimension D2 which is larger than the projecting dimension D1 on the bottom portion 41*a* forming the caulking recess portion 41. The pressing projection 42A is formed in a plane circular shape. In the pressing projection 42A, a cross-sectional shape along the direction orthogonal to the axis of the electric wire 10 and a cross-sectional shape along the axis of the electric wire 10 are formed in a circular arc shape. That is, the pressing projection 42A is a projection projecting hemispherically.

When the crimp cylinder portion 21 of the terminal 20, to which the fixing cylinder portion 31 of the fixing member 30 is fitted, is caulked using these dies 40A, the pressing projections 42A are bitten into the fixing member 30 and thus the crimping force at the crimping place is increased. However, since the planar shape of the pressing projections 42A of these dies 40A is small and the projecting dimension D2 is large, the pressing projections 42A are locally bitten into the fixing member 30. In this case, a great force is applied to the shield conductor 13 of the electric wire 10 and there is concern that the wires in the shield conductor 13 may be damaged.

In contrast, according to the first embodiment, the pressing projection 42 provided in the die 40 to increase the crimping force of the caulking portion is formed in a flat shape in which the length in one axial direction is longer than the length in the other axial direction orthogonal to the one axial direction in plan view. Thus, the area of the pressing projection 42 can be increased, and even when the projecting dimension of the pressing projection 42 is decreased, a sufficient crimping force can be secured. Accordingly, it is possible to reduce the stress concentration at the bitten place of the pressing projection 42 when the fixing cylinder portion 31 is caulked. Thus, it is possible to reduce damage to the shield conductor 13 formed of a braid of the electric wire 10 and to obtain a good shielding effect.

By caulking the fixing cylinder portion 31 such that the longitudinal direction of the pressing projection 42 is aligned in the direction orthogonal to the axis of the electric wire 10, the longitudinal direction of the crimp recess portion 33 to be formed in the fixing cylinder portion 31 can be aligned in the direction orthogonal to the axis of the electric wire 10. Thus, it is possible to make the terminal 20 compact by reducing the length of the fixing cylinder portion 31 in the axial direction.

Here, modification examples of the crimp recess portion 33 formed by the pressing projection 42 of the die 40 will be described.

Modification Example 1

Figure 9A:
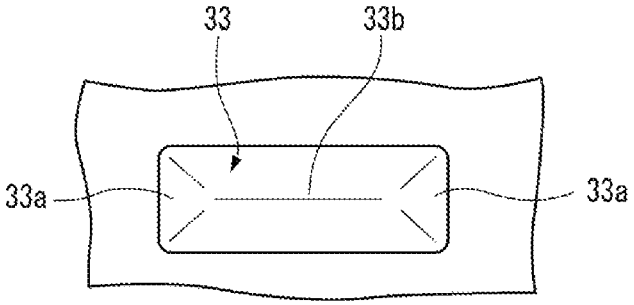
Figure 9B:
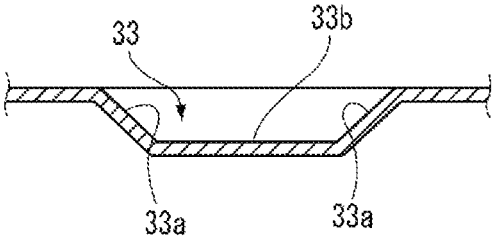
Figure 9C:
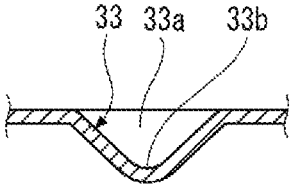

FIGS. 9A to 9C are illustrating a shape of a crimp recess portion according to Modification Example 1, FIG. 9A is a plan view, FIG. 9B is a cross-sectional view taken along a direction orthogonal to an axis of an electric wire, and FIG. 9C is a cross-sectional view taken along the axis of the electric wire.

As illustrated in FIG. 9A, in Modification Example 1, the planar shape of the crimp recess portion 33 is formed in a rectangular shape which is long in the direction orthogonal to the axis of the electric wire 10 in plan view. As illustrated in FIG. 9B, the cross-sectional shape of the crimp recess portion 33 along the direction orthogonal to the axis of the electric wire 10 is formed in a concave shape in which both end portions 33*a* are inclined and the both end portions 33*a* formed by the inclined surfaces are connected on the linear bottom portion 33*b*. As illustrated in FIG. 9C, the cross-sectional shape of the crimp recess portion 33 along the axis of the electric wire 10 is formed in a triangular shape.

Modification Example 2

Figure 10A:
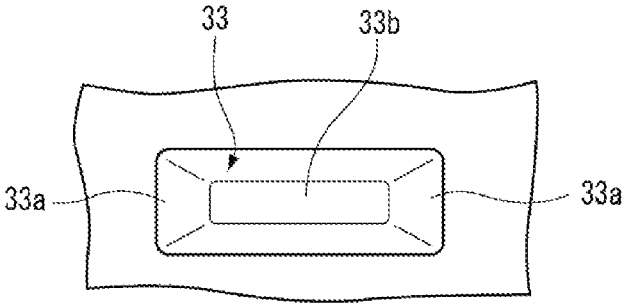
FIGS. 10A to 10C are illustrating a shape of a crimp recess portion according to Modification Example 2.
Figure 10B:
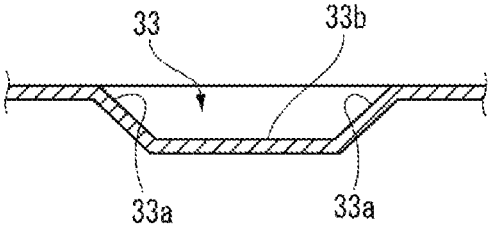
Figure 10C:
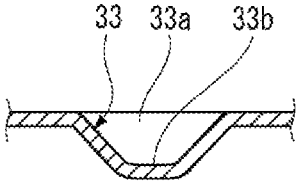

FIGS. 10A to 10C are illustrating a shape of a crimp recess portion according to Modification Example 2, FIG. 10A is a plan view, FIG. 10B is a cross-sectional view taken along a direction orthogonal to an axis of an electric wire, and FIG. 10C is a cross-sectional view taken along the axis of the electric wire.

As illustrated in FIG. 10A, in Modification Example 2, the planar shape of the crimp recess portion 33 is formed in a rectangular shape which is long in the direction orthogonal to the axis of the electric wire 10 in plan view. As illustrated in FIG. 10B, the cross-sectional shape of the crimp recess portion 33 along the direction orthogonal to the axis of the electric wire 10 is formed in a concave shape in which both end portions 33*a* are inclined and the both end portions 33*a* formed by the inclined surfaces are connected on the linear bottom portion 33*b*. As illustrated in FIG. 10C, the cross-sectional shape of the crimp recess portion 33 along the axis of the electric wire 10 is formed in a trapezoidal shape.

Also in Modification Examples 1 and 2, the crimp recess portion 33 is formed in a flat shape in which the length in one axial direction is longer than the length in the other axial direction orthogonal to the one axial direction in plan view. That is, the area of the crimp recess portion 33 is increased, and even when the depth dimension of the crimp recess portion 33 is increased, a sufficient crimping force is secured. Accordingly, it is possible to reduce the stress concentration when the crimp recess portion 33 is formed and to reduce the damage to the shield conductor 13 of the electric wire 10.

Second Embodiment

Next, a terminal crimping method and a terminal crimping structure of a according to a second embodiment will be described.

The same components as those of the first embodiment are denoted by the same reference numerals, and description thereof is omitted.

Figure 11:
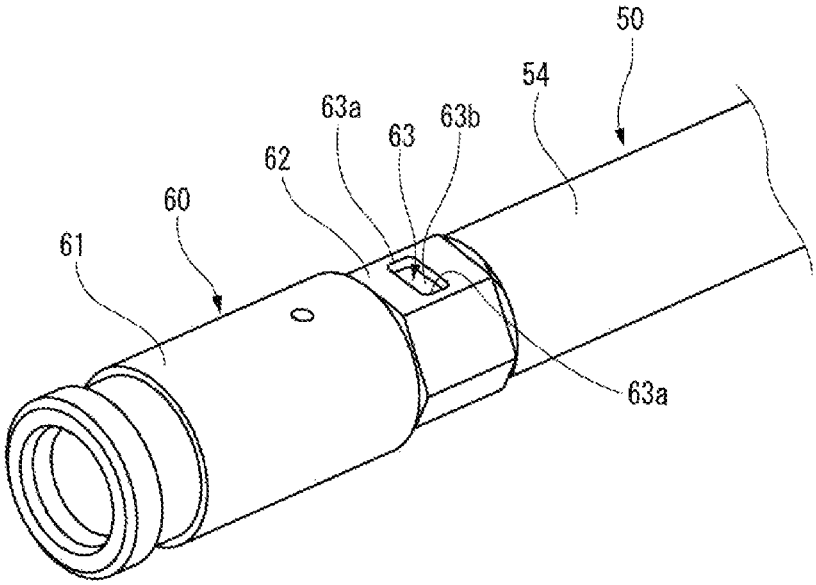
FIG. 11 is a perspective view of an end portion of an electric wire to which a terminal is crimped for explaining a terminal crimping structure according to a second embodiment.
Figure 12:
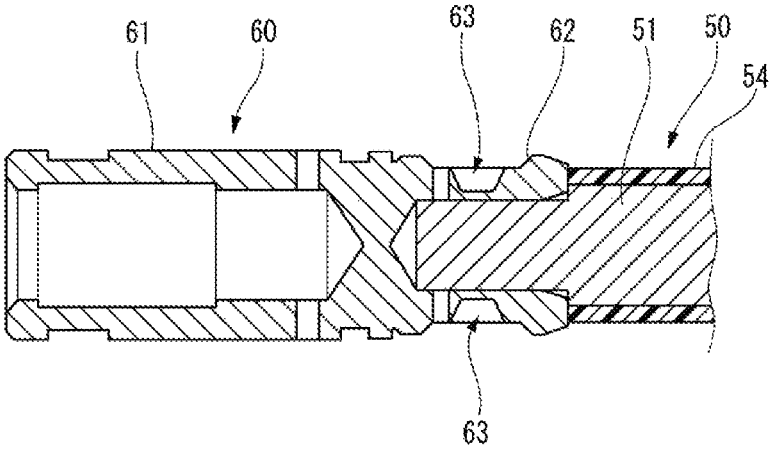
FIG. 12 is a cross-sectional view taken along an axis of the electric wire to which the terminal is crimped for explaining the terminal crimping structure according to the second embodiment.

FIG. 11 is a perspective view of an end portion of an electric wire to which a terminal is crimped for explaining a terminal crimping structure according to the second embodiment. FIG. 12 is a cross-sectional view taken along an axis of the electric wire to which the terminal is crimped for explaining the terminal crimping structure according to the second embodiment.

As illustrated in FIGS. 11 and 12, the crimping structure according to the second embodiment has a structure in which a terminal 60 is crimped and fixed to an electric wire 50.

The electric wire 50 includes a conductor 51 and a sheath 54. The conductor 51 is formed of, for example, a stranded wire formed by stranding element wires of copper or a copper alloy. The sheath 54 is formed of a resin material having insulating properties and is provided to cover the periphery of the conductor 51.

At the end portion of the electric wire 50, the conductor 51 is exposed. On the exposed conductor 51, a terminal 60 is mounted.

For example, the terminal 60 is formed of a conductive metal material such as copper or a copper alloy, and includes an electric connection portion 61 and a fixing cylinder portion 62. The electric connection portion 61 is a portion to be connected to the counterpart terminal. The fixing cylinder portion 62 is a portion to be connected to the conductor 51 of the electric wire 50.

The fixing cylinder portion 62 of the terminal 60 is caulked to have a hexagonal cross section. Thus, in the electric wire 50, the fixing cylinder portion 62 of the terminal 60 is crimped and fixed to an end portion of the conductor 51 exposed from the sheath 54. In the fixing cylinder portion 62 caulked to have a hexagonal cross section, crimp recess portions 63 are formed on two opposite surfaces of the six surfaces.

The planar shape of the crimp recess portion 63 is formed in a flat shape in which the length in one axial direction is longer than the length in the other axial direction orthogonal to the one axial direction in plan view. Specifically, the planar shape of the crimp recess portion 63 is formed in a rectangular shape which is long in the direction orthogonal to the axis of the electric wire 50 in plan view. The cross-sectional shape of the crimp recess portion 63 along the direction orthogonal to the axis of the electric wire 50 is formed in a concave shape in which both end portions 63*a* are inclined and the both end portions 63*a* formed by the inclined surfaces are connected on a linear bottom portion 63*b*. The cross-sectional shape of the crimp recess portion 63 along the axis of the electric wire 50 is formed in a trapezoidal shape.

Next, the crimping method of caulking and crimping the fixing cylinder portion 62 of the terminal 60 to the electric wire 50 will be described.

Figure 13A:
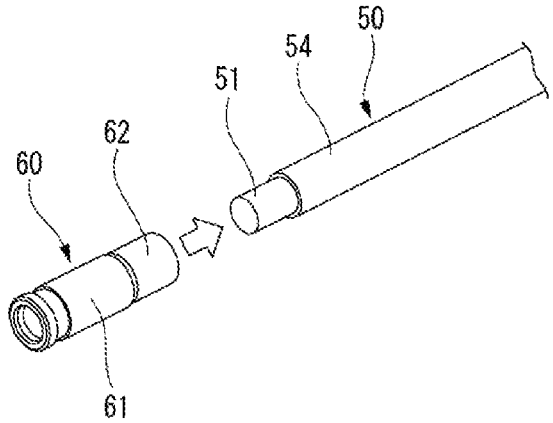
FIGS. 13A to 13C are views for explaining a procedure of crimping a terminal on an end portion of an electric wire, and are perspective views illustrating the end portion of the electric wire, respectively.
Figure 13B:
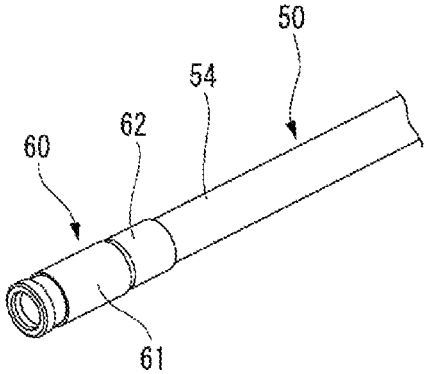
Figure 13C:
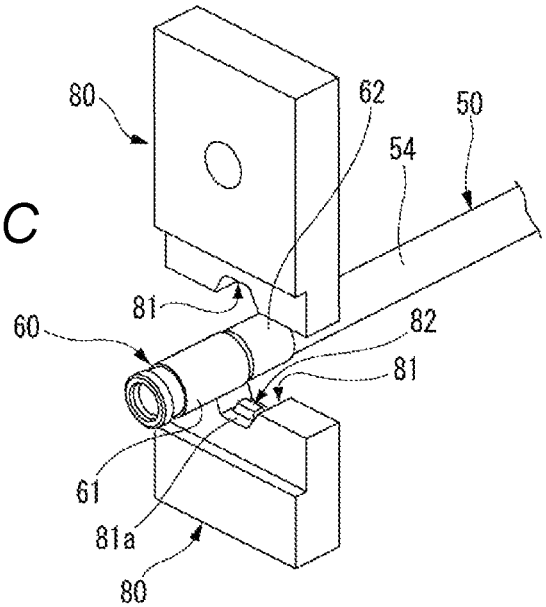

FIGS. 13A to 13C are views for explaining a procedure of crimping a terminal on an end portion of an electric wire, and FIGS. 13A to 13C are perspective views illustrating the end portion of the electric wire, respectively.

As illustrated in FIG. 13A, by subjecting the electric wire 50 to a terminal treatment, the conductor 51 is exposed. As illustrated in FIG. 13B, the fixing cylinder portion 62 of the terminal 60 formed in a cylindrical shape is inserted and fitted to the end portion of the electric wire 50. As illustrated in FIG. 13C, the fixing cylinder portion 62 of the terminal 60 is caulked by a pair of dies 80.

The dies 80 include trapezoidal caulking recess portions 81 formed by bisecting a hexagon on the abutting side of each other. On bottom portions 81*a* forming the caulking recess portions 81 of each die 80, pressing projections 82 are formed. The pressing projection 82 has a flat shape in which the length in one axial direction is longer than the length in the other axial direction orthogonal to the one axial direction in plan view. Specifically, the pressing projection 82 is formed in an oval shape which is long in the direction orthogonal to the axis of the electric wire 50 crimped in a planar shape in plan view, and the top portion is linearly formed. The cross-sectional shape of the pressing projection 82 along the axis of the electric wire 50 and the cross-sectional shape of the pressing projection along the direction orthogonal to the axis of the electric wire 50 are formed in a trapezoidal shape.

When the pair of dies 80 are abutted on each other with the fixing cylinder portion 62 of the terminal 60, to which the conductor 51 of the electric wire 50 is fitted, interposed therebetween, the fixing cylinder portion 62 is caulked by the caulking recess portions 81 of the dies 80 and is formed in a hexagonal shape. Thus, the terminal 60 is crimped and fixed to the end portion of the electric wire 50 and the conductor 51 of the electric wire 50 and the terminal 60 are electrically connected. The pressing projections 82 formed in the bottom portions 81*a* of the caulking recess portions 81 of each die 80 are bitten into the fixing cylinder portion 62 to form the crimp recess portions 63. Thus, the crimping force at the crimping place is increased.

According to the second embodiment like above, the pressing projection 82 provided in the die 80 to increase the crimping force of the caulking portion is formed in a flat shape in which the length in one axial direction is longer than the length in the other axial direction orthogonal to the one axial direction in plan view. Thus, the area of the pressing projection 82 can be increased, and even when the projecting dimension of the pressing projection 82 is decreased, a sufficient crimping force can be secured. Accordingly, it is possible to reduce the stress concentration at the bitten place of the pressing projection 82 when the fixing cylinder portion 62 is caulked. Thus, it is possible to reduce damage to the conductor 51 of the electric wire 50 and to obtain a good shielding effect.

Here, Reference Example 2 will be described.

Figure 14A:
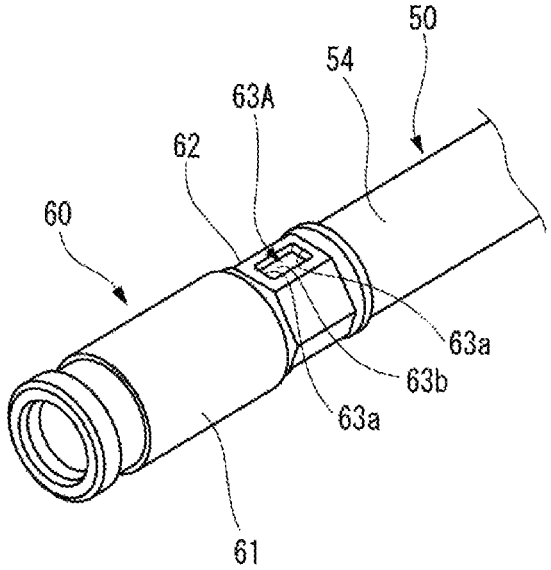
FIGS. 14A and 14B are views for explaining a crimping method and a crimping structure according to Reference Example 2, and are perspective views illustrating an end portion of an electric wire, respectively.
Figure 14B:
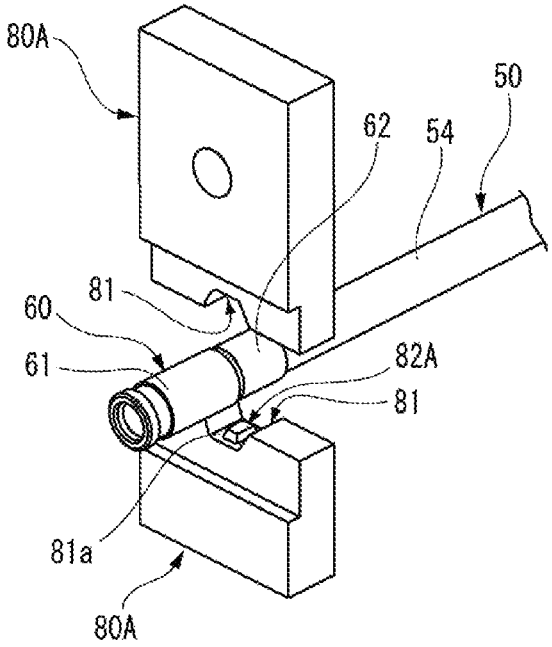

FIGS. 14A and 14B are views for explaining a crimping method and a crimping structure according to Reference Example 2, and FIGS. 14A and 14B are perspective views illustrating an end portion of an electric wire, respectively.

As illustrated in FIG. 14A, in Reference Example 2, in the fixing cylinder portion 62 caulked to have a hexagonal cross section, crimp recess portions 63A are formed on two opposite surfaces of the six surfaces. The planar shape of the crimp recess portion 63A is formed in a rectangular shape which is long along the axis of the electric wire 50 in plan view. The cross-sectional shape of the crimp recess portion 63A along the axis of the electric wire 50 is formed in a concave shape in which both end portions 63*a* are inclined and the both end portions 63*a* formed by the inclined surfaces are connected on the linear bottom portion 63*b*. The cross-sectional shape of the crimp recess portion 63A along the direction orthogonal to the axis of the electric wire 50 is formed in a trapezoidal shape.

In Reference Example 2, the fixing cylinder portion 62 of the terminal 60 is caulked using a pair of dies 80A. Each die 80A is provided with a pressing projection 82A on a bottom portion 81*a* of a caulking recess portion 81. The pressing projection 82A is formed in an oval shape which is long along the axis of the electric wire 50 crimped in a planar shape in plan view. The cross-sectional shape of the pressing projection 82A along the axis of the electric wire 50 and the cross-sectional shape of the pressing projection along the direction orthogonal to the axis of the electric wire 50 are formed in a trapezoid shape.

When the fixing cylinder portion 62 of the terminal 60 to which the conductor 51 of the electric wire 50 is fitted is caulked by the dies 80A, the pressing projections 82A formed in the bottom portions 81*a* of the caulking recess portions 81 of each die 80A are bitten into the fixing cylinder portion 62 and the crimp recess portions 63A are formed. Thus, the crimping force at the crimping place is increased.

However, in Reference Example 2, the fixing cylinder portion 62 of the terminal 60 is caulked by the dies 80A each provided with the pressing projection 82A formed in an oval shape which is long along the axis of the electric wire 50 crimped in a planar shape in plan view. Then, the crimp recess portions 63A each of which is long along the axis of the electric wire 50 in plan view are formed in the fixing cylinder portion 62 of the terminal 60. Therefore, the length of the fixing cylinder portion 62 of the terminal 60 along the axis of the electric wire 50 has to be increased and the size of the terminal 60 becomes large.

In contrast, according to the second embodiment, by caulking the fixing cylinder portion 62 such that the longitudinal direction of the pressing projection 82 is aligned in the direction orthogonal to the axis of the electric wire 50, the longitudinal direction of the crimp recess portion 63 to be formed in the fixing cylinder portion 62 can be aligned in the direction orthogonal to the axis of the electric wire 50. Thus, it is possible to make the terminal 60 compact by reducing the length of the fixing cylinder portion 62 in the axial direction.

Figure 15:
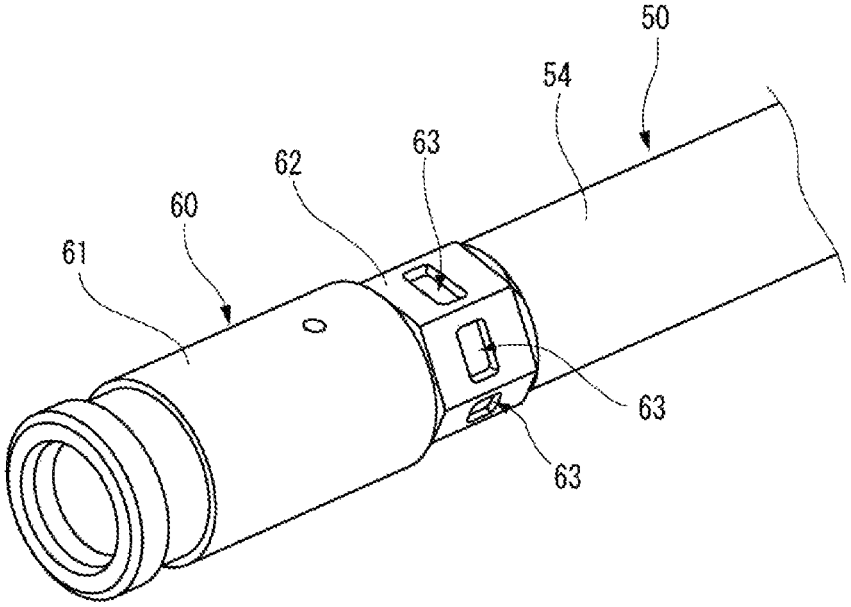
FIG. 15 is a perspective view of an end portion of an electric wire to which a terminal is crimped illustrating another example of a crimping structure of the terminal.

In the second embodiment, the crimp recess portions 63 are formed on two opposite surfaces of six surface of the fixing cylinder portion 62 caulked to have a hexagonal cross section. However, as illustrated in FIG. 15, the crimp recess portions 63 may be formed on all six surfaces of the fixing cylinder portion 62. Thus, the crimping force with the electric wire 50 can be further increased.

Incidentally, the invention is not limited to the above-described embodiments and suitable modifications, improvements or the like can be made. The material, shape, dimension, number and arrangement of each component in the above-described embodiments are not limited but can be arbitrarily set, as long as they can achieve the invention.

Here, the features of the embodiments of the terminal crimping method and the terminal crimping structure according to the invention described above are briefly summarized and listed below as [1] to [6].

[1] A terminal crimping method comprising:

covering an end portion of an electric wire (10, 50) with a fixing cylinder portion (31, 62) of a terminal (20, 60);

caulking and crimping the fixing cylinder portion (31, 62) by a pair of dies (40, 80) including pressing projections (42, 82) each having a flat shape in which a length in one axial direction is longer than a length in the other axial direction orthogonal to the one axial direction in a plan view; and caulking the fixing cylinder portion (31, 62) by the pressing projections (42, 82) to form crimp recess portions (33, 63), in the caulking and crimping the fixing cylinder portion (31, 62).

[2] The terminal crimping method according to [1], wherein the fixing cylinder portion (31, 62) is caulked by the dies (40, 80) such that a longitudinal direction of the pressing projection (42, 82) which is the one axial direction, is aligned in an orthogonal direction which is orthogonal to an axis direction of the electric wire (10, 50) in which the terminal (20, 60) is crimped.

[3] The terminal crimping method according to [1] or [2], wherein the electric wire (10) includes a shield conductor (13) formed of a braid, wherein the terminal (20) includes a crimp cylinder portion (21) through which the electric wire (10) is inserted and a fixing member (30) having the fixing cylinder portion (31), and wherein the fixing cylinder portion (31) is caulked by the dies (40), in a state that the shield conductor (13) which is folded back is disposed between the crimp cylinder portion (21) and the fixing cylinder portion (31) of the fixing member (30).

[4] A terminal crimping structure comprising:

an electric wire (10, 50); and a terminal (20, 60), wherein the terminal (20, 60) includes a fixing cylinder portion (31, 62) which covers an end portion of the electric wire (10, 50), wherein the fixing cylinder portion (31, 62) is calked and crimped, wherein crimp recess portions (33, 63) having a flat shape in which a length in one axial direction is longer than a length in other axial direction orthogonal to the one axial direction in plan view are formed in the fixing cylinder portion (31, 62) which is calked.

[5] The terminal crimping structure according to [4], wherein a longitudinal direction of the crimp recess portion (33, 63) which is the one axial direction, is aligned in an orthogonal direction which is orthogonal to an axis direction of the electric wire (10, 50) in which the terminal (20, 60) is crimped.

[6] The terminal crimping structure according to [4] or [5], wherein the electric wire (10) includes a shield conductor (13) formed of a braid, wherein the terminal (20) includes a crimp cylinder portion (21) through which the electric wire (10) is inserted and a fixing member (30) having the fixing cylinder portion (31), and wherein the fixing cylinder portion (31) is caulked, in a state that the shield conductor (13) which is folded back is disposed between the crimp cylinder portion (21) and the fixing cylinder portion (31) of the fixing member (30).

DESCRIPTION OF REFERENCE NUMERALS AND SIGNS

10, 50: electric wire
13: shield conductor
20, 60: terminal
21: crimp cylinder portion
30: fixing member
31, 62: fixing cylinder portion
33, 63: crimp recess portion
40, 80: die
42, 82: pressing projection

What is claimed is:

1. A terminal crimping method comprising:

covering an end portion of an electric wire with a fixing cylinder portion of a terminal;

caulking and crimping the fixing cylinder portion by a pair of dies including pressing projections each having a flat shape in which a length in one axial direction is longer than a length in the other axial direction orthogonal to the one axial direction in a plan view; and caulking the fixing cylinder portion by the pressing projections to form crimp recess portions, in the caulking and crimping the fixing cylinder portion, wherein the fixing cylinder portion is caulked by the dies such that a longitudinal direction of each of the pressing projections which is the one axial direction, is aligned in an orthogonal direction which is orthogonal to an axis direction of the electric wire in which the terminal is crimped.

2. The terminal crimping method according to claim 1, wherein the electric wire includes a shield conductor formed of a braid, wherein the terminal includes a crimp cylinder portion through which the electric wire is inserted and a fixing member having the fixing cylinder portion, and wherein the fixing cylinder portion is caulked by the dies, in a state that the shield conductor which is folded back is disposed between the crimp cylinder portion and the fixing cylinder portion of the fixing member.

3. A terminal crimping structure comprising:

an electric wire; and a terminal, wherein the terminal includes a fixing cylinder portion which covers an end portion of the electric wire, wherein the fixing cylinder portion is calked and crimped, wherein crimp recess portions having a flat shape in which a length in one axial direction is longer than a length in other axial direction orthogonal to the one axial direction in plan view are formed in the fixing cylinder portion which is calked, and wherein a longitudinal direction of each of the crimp recess portions which is the one axial direction, is aligned in an orthogonal direction which is orthogonal to an axis direction of the electric wire in which the terminal is crimped.

4. The terminal crimping structure according to claim 3, wherein the electric wire includes a shield conductor formed of a braid, wherein the terminal includes a crimp cylinder portion through which the electric wire is inserted and a fixing member having the fixing cylinder portion, and wherein the fixing cylinder portion is caulked, in a state that the shield conductor which is folded back is disposed between the crimp cylinder portion and the fixing cylinder portion of the fixing member.

* * * * *